US006098752A

United States Patent [19]

McCaleb

[11] Patent Number: 6,098,752

[45] Date of Patent: Aug. 8, 2000

[54] ENVIRONMENTALLY SAFE FLUID CHANGING SYSTEM

[76] Inventor: David A. McCaleb, 4645 Ramblewood Dr., Colorado Springs, Colo. 80920

[21] Appl. No.: 09/432,398

[22] Filed: Nov. 2, 1999

Related U.S. Application Data

[63] Continuation-in-part of application No. 08/917,800, Aug. 27, 1997, abandoned.

[51] Int. Cl.[7] ..... F16C 3/14

[52] U.S. Cl. ..... 184/1.5; 184/6.28; 184/26; 123/196 R; 141/98

[58] Field of Search ..... 184/1.5, 6.28, 184/26, 6.5, 6.12; 123/196 R; 141/98

[56] References Cited

U.S. PATENT DOCUMENTS

| | | |
|---|---|---|
| 4,151,823 | 5/1979 | Grosse . |
| 4,520,852 | 6/1985 | Klein . |
| 4,674,456 | 6/1987 | Merritt . |
| 4,951,784 | 8/1990 | Bedi . |
| 4,964,373 | 10/1990 | Bedi . |
| 5,044,334 | 9/1991 | Bedi . |
| 5,062,348 | 11/1991 | Bedi et al. . |
| 5,090,376 | 2/1992 | Bedi . |
| 5,209,198 | 5/1993 | Bedi . |
| 5,246,086 | 9/1993 | Yunick . |
| 5,372,219 | 12/1994 | Peralta . |
| 5,390,762 | 2/1995 | Nelson . |
| 5,526,782 | 6/1996 | Bedi et al. . |
| 5,546,999 | 8/1996 | Parker . |
| 5,676,842 | 10/1997 | Bedi et al. . |
| 5,787,372 | 7/1998 | Edwards et al. . |

OTHER PUBLICATIONS

Filterlock E–Z Drain Kits J C Whitney Catalog No. 606J Dec. 31, 1997.

*Primary Examiner*—David M. Fenstermacher

[57] ABSTRACT

An oil changing device and process that allows a customer to service the fluids in an internal combustion engine or automatic transmission (their application) in a completely environmentally safe manner. The device is a conveniently located oil changing center where the entire process can be accomplished safely, quickly, cleanly, and at a low cost. The oil changing center includes a sealable container (4) containing an oil filter (2), a first quick disconnect coupling (14), and a second quick disconnect coupling (16). The couplings allow access to the application's oil sump (32) and lubrication system. When a customer wishes to change their oil, they attach an evacuation oil pump (18) to the quick disconnect couplings and evacuate all the dirty oil from the oil sump and lubrication system into a dirty oil holding tank (22). They then replace the oil filter. A fill oil pump (24) is attached to the quick disconnect couplings and fills the application with an appropriate amount of oil. During the entire process, neither the environment or the customer is ever endangered. This process and device allow for a completely clean operation.

14 Claims, 3 Drawing Sheets

ENVIRONMENTALLY SAFE FLUID CHANGING SYSTEM

This application is a continuation in part of application Ser. No. 08/917,800, filed Aug. 27, 1997, now abadoned.

BACKGROUND

1. Field of the Invention

This invention relates to a device and process for changing oil from an internal combustion engine, automatic transmission, or similar application in an environmentally safe, completely clean, quick, cost effective, and simple manner.

2. Description of the Prior Art

Changing engine or transmission fluid is a dirty, dangerous task performed millions of times each day by ordinary, unskilled people. The process of changing fluids is crude and rudimentary. It is almost impossible to perform a clean job, without hurting the environment or yourself Over one million gallons of used motor oil are improperly disposed of each year in South Carolina alone. Think of how many are disposed of all over the United States, or even the world! Just one gallon of used motor oil is enough to contaminate one million gallons of water! Additionally, exposure to dirty oil has been proven to contribute to cancer.

To change oil at home, the vehicle must be raised and the customer has to get underneath to service the drain plug and the filter. The vehicle, weighing up to several tons, many times is not properly supported by jack stands. This places the customer in a dangerous, potentially fatal position. The oil must be drained from the oil pan, caught in a catch pail, and the filter changed without spilling dirty oil. Spilled oil contaminates the environment when it is wiped up and the oily rags are improperly disposed. Many times the used oil is stored in improper containers never to be recycled. It finds its way into the environment by being poured out onto the ground or down the drain. The empty oil containers are an environmental hazard, taking up space in landfills and leaking oil into our environment. The entire oil changing process can take up to twenty minutes for someone who is experienced, much longer for someone who is not. Inevitably, the customer is frustrated and filthy with carcinogenic oil. He has placed himself and the environment in danger. Inevitably, he has done some harm to our environment.

For those customers who do not have the expertise to change their own oil or do not desire the frustration associated with doing it themselves, their only option is to pay someone else to do it for them. For a customer to change their oil at a typical quick-stop oil change center, they can expect several things. First, they can expect to spend about thirty dollars every three thousand miles. They can also expect to be pressured to purchase extra services. However, these are not the biggest drawbacks to paying someone else to change your oil.

The biggest drawback to these quick-stop oil change services is the inherent inconvenience. The only times it is convenient to service a vehicle are the same times that are convenient for everyone else. This leads to long waiting lines, effectively reducing the quick-stop oil change services' convenience. A customer can expect to wait in line for at least thirty minutes. It is not until they make it through the waiting line that the service only takes the advertised ten minutes. A typical customer does not have the time to service their car on the way to work because the lines would make them late for work. Lunch is not convenient because of the short time available, and again there are the lunch hour lines to deal with. A customer does not want to fight the rush hour business and wait in line a half-hour or more on their way home after a long day of work either. The weekends are available, but the quick-stop service centers are busy then also and who wants to waste what little free time they have waiting in line? They therefore typically put it off as long as possible, wearing out their vehicle prematurely due to improper fluid service intervals. Additionally, despite service garages' efforts to maintain clean operations, they lack the proper tools and equipment to perform a clean, environmentally safe job.

There have been attempts at making the oil change process better. U.S. Pat. No. 5,209,198 describes a device and method of changing motor oil in an internal combustion engine. This device and method still suffer from many ailments, mainly environmental stewardship. It allows the environment to be harmed by spilled dirty oil. This device has no means of recovering the dirty oil that dribbles from the oil filter during its change. Further, an additional amount of dirty oil will always escape during the connection and disconnection of the quick change couplers attaching the pump device. The environment is therefore still at risk with this system U.S. Pat. No. 5,209,198 is overly complex for a typical customer to operate. Different valves have to be opened and closed at certain times to drain the engine, flush it, and refill it with oil. A typical customer needs a simple process so as to ensure they will properly service their vehicle. This method's complex nature could easily confuse a customer and allow them to accidentally fill their engine with flushing fluid rather than oil. The results of an improper oil change can be catastrophic engine failure within a few minutes. This will always prove to be costly.

U.S. Pat. No. 5,209,198 also can put unfiltered oil through the lubrication system of the engine. This unfiltered oil is pumped into the lubrication system through the same conduits and pump that evacuate the dirty oil and flushing solvent from the engine. These conduits and pump will become contaminated over time, contaminating the clean oil before it is pumped into the engine. Additionally, the complexity of the system makes it expensive to produce, complex to employ, and still dangerous for the environment. This device fails to solve the age old problems of oil changing.

U.S. Pat. No. 4,151,823 describes a cartridge device for changing oil. This device, however, would prove to be unwieldy to handle. A typical customer would not have the strength or expertise to change their own oil. These cartridges would require major reengineering to adapt them to anything, adding cost and complexity. More expense would be incurred since a customer would have to have access to two of these cartridges, one for the engine and another for recycling. One size cartridge would never fit all applications, so even more complexity would be needed to satisfy every vehicle's requirements. This would prove to be a logistical nightmare. Further, this system provides no means of safely capturing any spilled oil from the self sealing input and output lines during the changing process. Therefore, the environment is still at risk. This device is weighty, costly, unwieldy, complex, logistically perplexing, and still environmentally unsound.

Many other devices and methods have attempted to make oil changing sensible. U.S. Pat. Nos. 5,390,762 (1992), 4,674,456 (1985), 5,426,086 (1991), and all other prior art still suffer from similar disadvantages:

(a) Environmental stewardship: Their devices and methods provide no absolute assurance that the environment will not be adversely affected through the oil change process. Many systems still require oil to be drained into some sort of catch pail. In all of these systems, there is a chance for oil to contaminate the environment.

(b) Expense: Their complexity leads to expensive manufacture and use. This means that manufacturers will be apprehensive to employ such systems. In most cases, these devices require the application to be substantially modified to accommodate them Such reengineering is expensive and is motivation against their adaptation and employment. Costs are further increased in the use of such systems. The cost of an oil change would be comparable to having a specialist do it for you. Special tools and knowledge are required to maintain these systems, driving costs higher. In short, their complexity leads to higher prices through their adaptation to the engine or transmission, their employment, and their maintenance.

(c) Complexity: Their complexity is a further deterrent for the unwary customer to use them properly, or even at all. A typical customer is wary of changing their own oil and deem a complex system as too much for them to handle by themselves. They will then have to resort to the help of an expensive specialist.

(d) Accessibility: These systems would not be practical until widespread market acceptance was established. There would be customers of these systems without any means of maintenance or even changing their oil until the proper logistical distribution system was established.

(e) Dependability: An internal combustion engine's or automatic transmission's lifeblood is its oil. Without a proper level of oil, they will reach catastrophic failure within a matter of seconds. The prior art's complexity means there are more areas for the system to break down and fail. Failure means that the engine or transmission will be harmed, if not destroyed. This is a very expensive error.

(f) Practicality: Because of all the above reasons, all prior art has proven to be impractical. It is environmentally unsound, complex, expensive, inaccessible, unreliable, expensive, logistically challenging, and completely unlikely to be adapted to the market. The prior art's market acceptance has not been anything near significant, meaning that it has been rejected as impractical.

(g) Safety: Through the use of prior art systems, the customer is still put danger by coining in contact with carcinogenic dirty oil. Further, many times the customer is still required to get under a heavy vehicle. A typical customer does not have the tools to properly suspend their vehicle, increasing the danger of the vehicle falling and crushing the customer.

OBJECTS AND ADVANTAGES

Accordingly, several objects and advantages of my invention are:

(a) to provide an environmentally safe means of changing oil in an internal combustion engine, automatic transmission, or similar application;

(b) to provide a system that is inexpensive to adapt to any application, requiring no or a negligible amount of modification to the application;

(c) to provide a system that is as simple as possible, allowing any customer to easily change their oil;

(d) to provide a system that allows for a customer to change their oil without depending upon a specialist;

(e) to provide a system that is dependable, and least likely to fail or allow customer error leading to failure;

(f) to provide a system that provides for a low cost oil change;

(g) to provide a system that provides for a fast oil change;

(h) to provide a system that can be serviced anywhere, at any time;

(i) to provide a system that is highly marketable, therefore meeting customer's needs while ensuring acceptance with needed manufacturers;

(j) to provide a system that is safe to operate-that does not place the customer in danger while changing their oil.

Further objects and advantages are the removal of all motivation for a customer to improperly change their oil, and the provision of the necessary equipment to do a proper job. Currently, the average customer does not have the equipment to properly perform an oil change. This system provides them with that equipment. The customer also has little motivation to be environmentally conscious. Although there are many legal ways of mandating environmental stewardship, these methods are often viewed as punishment. People abide by these laws because of what will happen to them if they do not, rather than thinking of how the law benefits our environment. Conversely, this invention provides positive motivation to be an environmental steward. The system makes oil changes much cleaner, cheaper, easier, safer, and faster than doing it at home or at a quick-stop oil change center.

This invention provides significant cost savings to the customer who is used to paying up to thirty dollars every three thousand miles to change their oil. They only need pay for the meager cost of new oil and a filter. It provides no chance for the environment to be exposed to harmful fluids. It is designed with simplicity in mind so that anyone who can figure out how to fill their car with gas can change their fluid. It makes changing fluid a simple, safe, and fast process. The simplicity of the system design also lends itself to very low cost production and adaptation.

A customer no longer has to dangerously creep under their vehicle at home to change their oil. This system allows the customer to change their oil at a gasoline service station while they are filing up with gas. By the time their tank is full of gas, they should be done changing their oil. When finished, the used oil is safely stored in a proper container ready to be recycled. Never is it allowed to contaminate the environment nor dirty the customer. There are no empty oil containers to dispose of The system also allows the flexibility of the customer changing their oil at home with all the same conveniences.

DRAWING FIGURES

DESCRIPTION OF THE INVENTION

Figure 1:
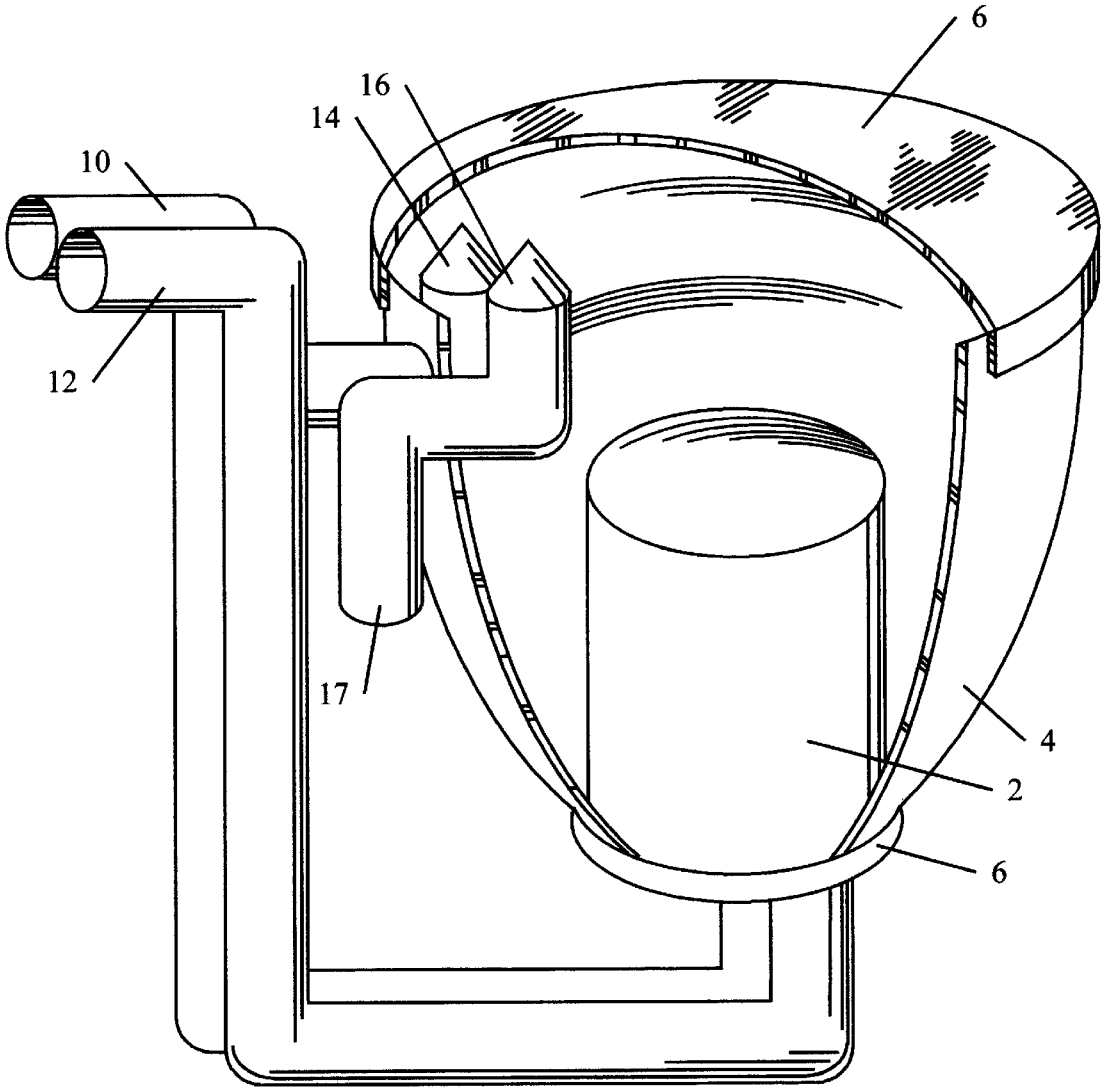
FIG. 1 shows a side view of a fluid changing center. This view is a cutaway view to better illustrate the internal components.

FIG. 1 shows a typical embodiment of a fluid changing center. The main portion of the fluid changing center is housed in a sealable container 4. The sealable container should be of appropriate size, allowing it to be conveniently near an application 30 to which it is applied. The application 30 is one of the group of devices that contain lubricating fluid, a fluid sump, and a lubrication/filtration system such as internal combustion engines, automatic transmissions, hydraulic reservoirs, manual transmissions, radiators, or axle housings. The sealable container has a removable panel 6, allowing access to its contents. A fluid filter 2 is located within the sealable container. The fluid filter is mounted so it is easily grasped by the customer. The filter is connected to a remotely mounted oil filter boss 8. The remotely mounted oil filter boss is located at the bottom of the sealable container, with the fluid filter mating surface facing up. The sealable container is shaped in a sloped manner toward its bottom where the oil filter boss's fluid filter mating surface is located.

The oil filter boss is connected to the application's internal lubrication system through a feed line 10 and a return line 12. The feed line consists of a high pressure/high temperature conduit feeding the fluid filter with fluid from the application's fluid pump 34. The return line consists of a high pressure/high temperature conduit returning fluid from the fluid filter to the application's internal lubrication system. The feed line and return line should be routed above the top of the sealable container at some point. Therefore, the application's lubrication system is comprised of the application's fluid pump 34, feed line 10, return line 12, fluid filter 2, remotely mounted oil filter boss 8, and the internal lubrication distribution passages of the application.

Figure 2:
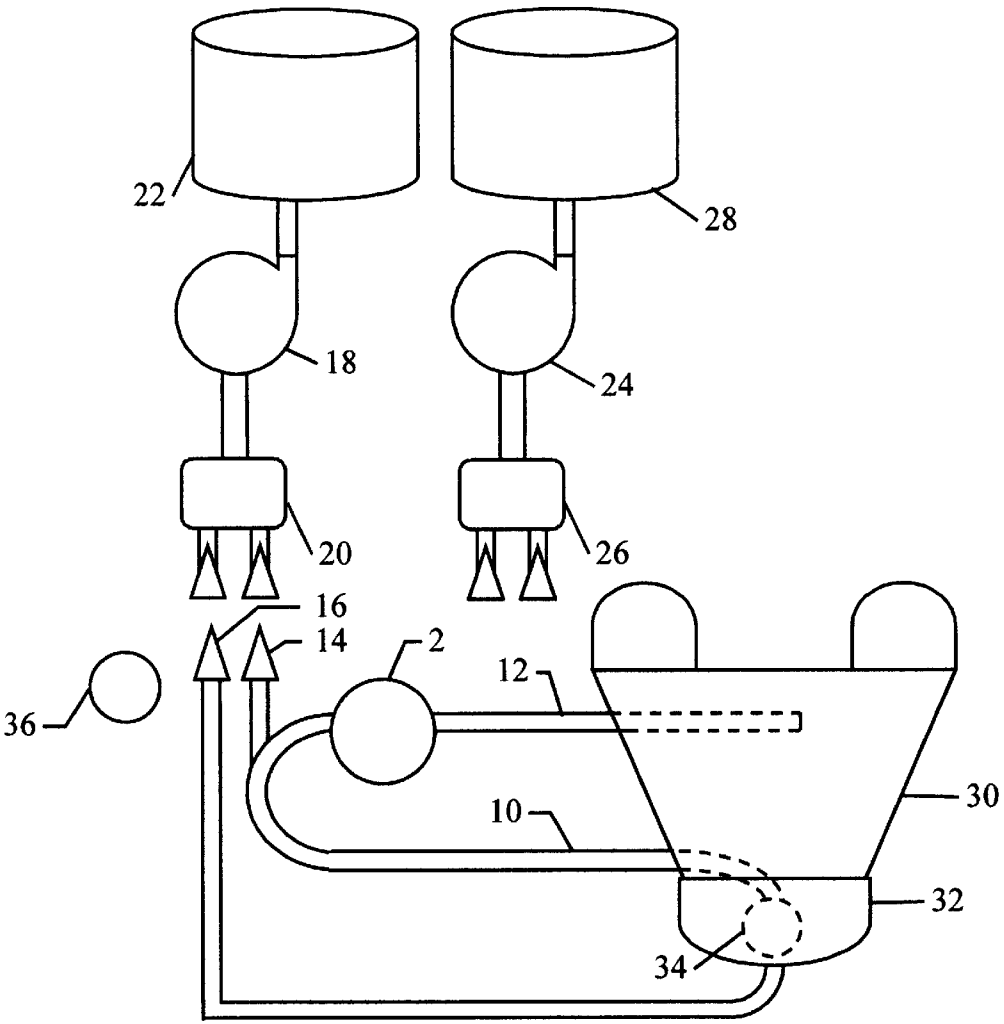
FIG. 2 is a schematic representation of the device of the present invention and all supporting equipment.
Figure 3:
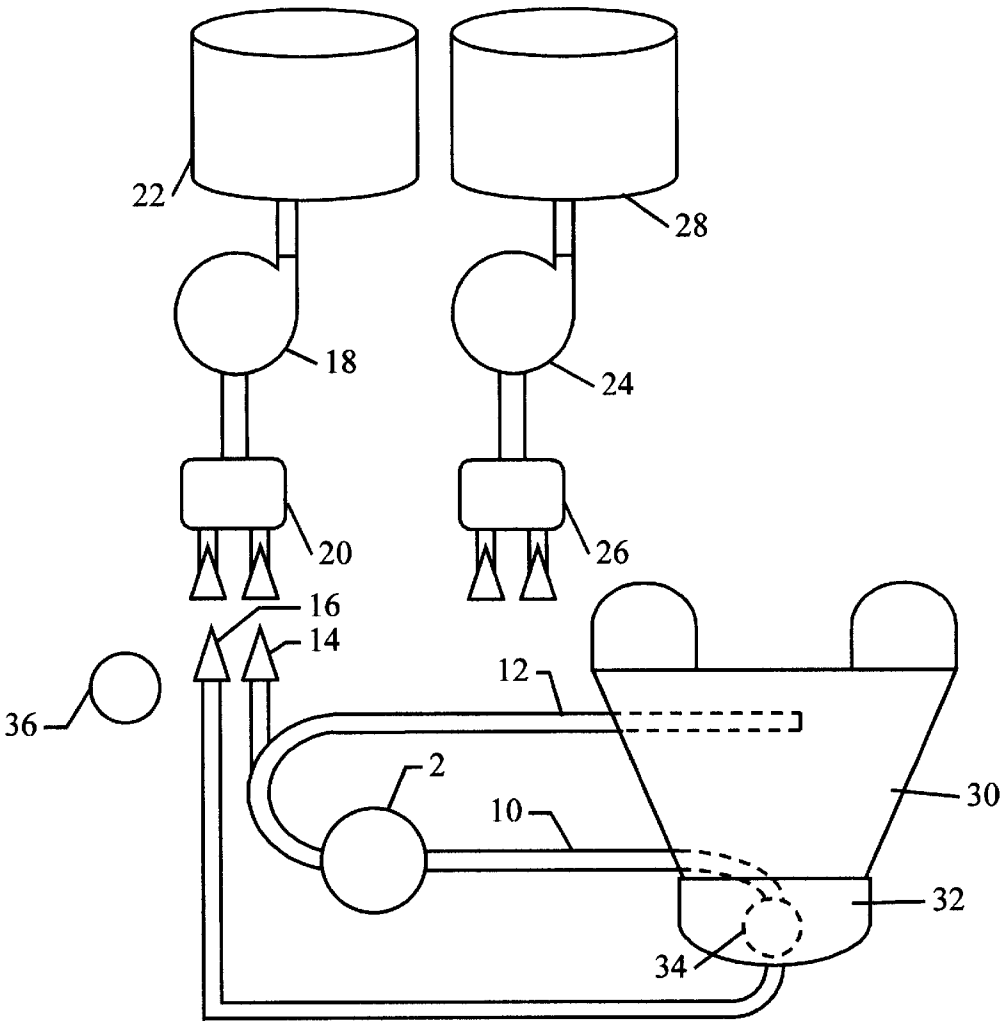
FIG. 3 shows the first quick disconnect coupling in a downstream location.

A first quick disconnect coupling 14 and a second quick disconnect coupling 16 are located within the container. The first quick disconnect coupling is in fluid communication with the return line 12 by means of the oil filter boss. Alternatively, the first quick disconnect coupling can be in fluid communication with the feed line 10. If the first quick disconnect coupling is connected such that it is in fluid communication with the return line 12, it is connected downstream of the fluid filter as shown in FIG. 2. Alternatively, if the first quick disconnect coupling is connected such that it is in fluid communication with the feed line 10, it is connected upstream of the fluid filter as shown in FIG. 3. The second quick disconnect coupling is the terminal end of a fluid conduit 17 in fluid communication with a fluid sump 32 of the application.

An evacuation fluid pump 18 is able to be sealingly attached to the first and second quick disconnect couplings simultaneously using a pump out nozzle 20. The evacuation fluid pump is attached in fluid communication with the pump out nozzle. The evacuation pump is able to produce sufficient suction force to expedite evacuation of the application's dirty fluid. The evacuation fluid pump deposits the dirty fluid in a suitable dirty fluid holding tank 22.

A fill fluid pump 24 is able to be sealingly attached to the first and second quick disconnect couplings simultaneously using a fill nozzle 26. The fill fluid pump is attached in fluid communication with the fill nozzle. The fill fluid pump is able to produce sufficient pumping force to expedite filling the application with fresh fluid. The fill pump is in fluid communication with a fresh fluid reservoir 28 from which it fills the application with fluid.

Operation

This invention provides for the environmentally safe, convenient, low-cost, quick, and absolutely clean changing of fluid and fluid filter from any application. It can be easily applied to internal combustion engines or automatic transmissions. This system can also be adapted to other applications containing oil and lubrication systems, such as: manual transmissions, radiators, axle housings, hydraulic reservoirs, or any other reservoirs containing potentially environmentally dangerous fluids.

While the application is running, the lubrication system of the application operates as follows: Lubricating fluid is pumped out of the fluid sump 32 by the application's fluid pump 34. The fluid flows through the feed line 10 through the remotely mounted oil filter boss 8 into the fluid filter 2. The fluid is then filtered of impurities as it flows through the fluid filter back through the oil filter boss 8 through the return line 12 to the application's internal lubrication system.

The feed line 10 and return line 12 should be fashioned in such a manner as they are placed at a higher level than the top of the fluid filter at some point between the oil filter boss and engine block. The reason for this is to prevent the fluid filter from draining while the application is shut off, leading to a dry start the next time the application is started. The odd position of the fluid filter makes this necessary. Recall that the fluid filter is placed bottom up, within convenient reach of the customer. This means that the fluid filter is probably located above the oil sump. Without the fluid lines being placed above the fluid filter at some point, gravity will drain the fluid from the filter into the fluid sump, causing a dry startup. This method is simpler, more dependable, and much more cost effective than check valves. Dry starts will eventually cause premature engine wear.

The customer changes their fluid in three easy steps. The steps are 1) evacuate the dirty fluid from the fluid sump and the lubrication system, 2) replace fluid filter, and 3) fill the fluid sump and lubrication system with fresh fluid. These steps and their operation are explained below and referenced by corresponding step numbers.

1) Evacuate Dirty Fluid From Fluid Sump and Lubrication System

The first thing a customer does is stop the application and locate the fluid change center. The center should be of appropriate size and position to allow convenient service, while being as compact as possible. This erases the need for the customer to ever get underneath a suspended vehicle. They then pull off the removable panel 6 from the sealable container 4, attach the evacuation fluid pump 18 by placing the pump out nozzle 20 simultaneously onto the first quick disconnect coupling 14 and second quick disconnect coupling 16.

The first quick disconnect coupling 14 and second quick disconnect coupling 16 are male hydraulic quick release couplings that prevent any fluid flow after they are disconnected. This prevents leaks while the application is running. They are placed close together and toward the top of the sealable container 4, allowing easy service. The first quick disconnect coupling 14 is the service point for the fluid filter 2 and the application's lubrication system. Therefore, this coupling allows the fluid filter and lubrication system to be drained and refilled with fluid. The first quick disconnect coupling 14 is fluidly connected with the return line 12 (downstream of the fluid filter) or the feed line 10 (upstream of the fluid filter). Whether the first quick disconnect coupling 14 is connected upstream or downstream depends largely upon whether the fluid filter contains an anti-drainback valve and how the filter is to be mounted. The main subject of importance is that the first quick disconnect coupling must be fluidly connected with the remotely mounted oil filter boss, either upstream or downstream, in a manner that allows the fluid to be completely evacuated from the fluid filter under suction force when an evacuation fluid pump is attached to the first quick disconnect coupling.

Many fluid filters have anti-drainback valves to prevent the fluid from draining from the filter while the application is not in service. This anti-drainback valve prevents fluid from flowing the opposite direction of it's normal flow, from upstream to downstream. Locating the first quick disconnect coupling downstream of the fluid filter allows the fluid filter to be drained by means of a suction force produced by the evacuation fluid pump when the evacuation fluid pump is connected to the first quick disconnect coupling. If the fluid filter has an anti-drainback valve, locating the first quick disconnect coupling upstream will prevent the fluid from being drained from the fluid filter since the evacuation fluid pump will be attempting to drain the fluid from the fluid filter in a direction against the anti-drainback valve.

Alternatively, the first quick disconnect coupling can be connected upstream of the fluid filter if a fluid filter without an anti-drainback valve is utilized. Connecting the first quick disconnect upstream of the fluid filter allows the fluid filter to be mounted upside down. Traditionally, fluid filters are hung from the remotely mounted oil filter boss. However, if the fluid filter is mounted upside down, with the bottom of the fluid filter pointing up so that it is easily grasped by the customer, it is necessary to connect the first quick disconnect coupling upstream.

An upstream connection is necessitated with the bottom up configuration because of the design of the remotely mounted oil filter boss. The remotely mounted oil filter boss, when mounted in a manner that places the fluid filter bottom up, has the feed line 10 (upstream connection) accessing the fluid filter at a lower point than the return line 12 (downstream connection). The feed line 10 accesses the fluid filter through the base of the remotely mounted oil filter boss while the return line 12 accesses the fluid filter through the threaded tube that protrudes up into the fluid filter. The fluid filter is threaded onto this threaded tube to secure it to the remotely mounted oil filter boss in the same manner it would traditionally connect to the engine. Therefore, only a suction force applied upstream (through feed line 10) of the fluid filter will completely drain the fluid filter. If a suction force is applied upstream, gravity drains the fluid into the base of the remotely mounted oil filter boss where it can be evacuated. However, if a suction force is applied downstream (through return line 12), the fluid is only drained down to the point where the threaded tube protrudes up into the fluid filter. Gravity prevents any further fluid from being evacuated up over the top of the threaded tube and the fluid filter is not completely drained prior to changing the filter. Therefore, it is necessary to connect the first quick disconnect coupling upstream of the fluid filter if the fluid filter is mounted bottom up. This configuration requires the use of a fluid filter that does not contain an anti-drainback valve so that the valve does not prevent fluid evacuation.

Because they are attached to the lubrication system, all methods of fluid transfer must be suited to high pressure and high temperature for extended periods of time.

The second quick disconnect coupling 16 is the service point for the fluid sump 32. It is the terminal end of fluid conduit 17. Fluid conduit 17 connects to the bottom of the fluid sump. The second quick disconnect coupling allows for the fluid sump to be drained and refilled with fluid. Since this conduit is never exposed to high pressures, it need only be capable of resisting high heat for extended periods of time. All conduits must not collapse under suction as the fluid from the fluid sump is evacuated.

The reason that the first quick disconnect coupling 14 and second quick disconnect coupling 16 should be male is because it is more cost advantageous. There will be far more applications produced with this system than evacuation fluid pumps and fill fluid pumps. One set of pumps can service many applications. Therefore, these couplings contain the less expensive male couplings.

The customer will turn on the evacuation fluid pump and evacuate all the fluid from the application's lubrication system and fluid sump simultaneously. This will evacuate all fluid from the fluid filter 2, remotely mounted oil filter boss 8, feed line 10, and return line 12.

2) Replace Fluid Filter

The customer continues to run the evacuation fluid pump 18 as they replace the old fluid filter 2 in the traditional manner of unscrewing the old filter and screwing on a new one. The fluid filter should be mounted bottom-up, so that it is easily grasped by the customer. The old fluid filter is recycled in an environmentally sound manner. Any excess fluid that may still drip from the old filter quickly runs down the sloped sides of the sealable container 4 into the remotely mounted oil filter boss's fluid filter mating surface located at the bottom of the sealable container. It is then evacuated by the evacuation fluid pump. This prevents the environment and the customer from ever coming in contact with any dirty fluid. No clean up rags are needed.

3) Fill Fluid Sump and Lubrication System With Fresh Fluid

Once the new filter is in place, the customer removes the pump out nozzle 20 and attaches the fill nozzle 26 simultaneously to the first quick disconnect coupling 14 and second quick disconnect coupling 16. They then fill up the fluid sump 32 and the application's lubrication system with the required amount of fluid for the application. Filling the fluid filter and lubrication system in this manner prevents the usual dry start occurring after a fluid change. This dry start occurs in the first few seconds as the engine or transmission begins to operate but before its lubrication system is filled and pressurized.

The customer can now check their fluid level immediately since not only are the fluid filter and lubrication system full, but the fluid sump is filled from the bottom up. This prevents the usual wait for fluid to drain into the fluid sump. The customer then replaces the removable panel on the sealable container, sealing any remnants of dirty fluid inside without the need to contaminate rags by cleaning up. There are no containers to be disposed of The fluid change is now complete.

Conclusion, Ramifications, and Scope

Thus the reader will see that the Environmentally Safe Fluid Changing System will provide a completely environmentally stewardous, clean, quick, safe, inexpensive fluid change. It solves all longstanding, known problems with fluid changes in a practical, simple manner. It provides positive motivation to be an environmental steward and has the additional advantages in that:

- It gives the fluid no chance to contaminate our environment or dirty the customer. The used fluid is safely stored in a proper container ready to be recycled. There are no empty fluid containers to dispose of and contaminate landfills, and no drips or spills to clean up. This means that there are no contaminated rags to be thrown away.
- It allows a customer to change their fluid in approximately one minute. This is at least thirty times faster than the average home fluid change and fifteen times faster than an average quick-stop oil change (not including the waiting line).
- Never does a customer have to dangerously crawl under a suspended vehicle, risking personal injury. The Environmentally Safe Fluid Changing System is completely safe to operate. All operation is done from the fluid change center conveniently located under the hood of the vehicle. Additionally, our environment is safe from contamination from improperly disposed fluid.

Pits, jacks, or other expensive suspension devices to raise and lower the vehicles are no longer needed. All work is done from the fluid change center.

Environmental stewardship, speed, safety, and the elimination of expensive equipment make the apparatus and its process a practical, marketable, and profitable system. This practically answers the age old problems of fluid changing that were perceived to be insolvable, producing a materially different outcome from all known conventional processes.

While my above description contains many specificities, these should not be construed as limitations on the scope of the invention, but rather as an exemplification of one preferred embodiment thereof. Many other variations are possible. For example:

The process can be simplified for the customer even further, depending on the pumps and couplings connecting those pumps to the application. For example, an information transfer device 36 can prompt the customer for the type of vehicle they are driving, and calculate the needed amount of fluid. This could easily be done in a similar manner as the electronic aids found in auto parts stores that help select what type of fluid filter, wiper blades, or air filter is needed. This same electronic aid could help the customer pick out a new fluid filter at the pump as well. The pump then evacuates the fluid from the fluid filter and fluid sump, prompt the customer to replace the fluid filter, and then fills the application up with the calculated amount of fluid.

The system can be even more user friendly by the information transfer device. When the customer attaches the pump out nozzle, all pertinent data is transferred to the pump automatically. The pump will know how much fluid the application requires and what filter is required as a replacement. All that is be needed to do is for the customer to change the filter or nozzle when prompted by the pump. The pump will know from the information transfer device 36 how much fluid the application needs without prompting the customer.

The system can be operated through a single service coupling instead of a pump out nozzle 20 and a fill nozzle 26. Simply attach the service coupling to the application, replace your fluid filter, and then fill your system with fluid without the need to detach the pump out nozzle 20 and attach a fill nozzle 26. One coupling can do it all.

The process can be further simplified for the customer. The information transfer device 36 can prompt the user through recorded voice commands or a recorded video demonstration. It is inevitable that these and other conveniences will soon be implemented as the customer demands them.

If a customer still wishes to change their fluid at home, any fluid pump such as a drill operated fluid pump can be used, placing the fluid into a sealed container. They can use another pump to fill the application with fresh fluid from another sealed container. If the container is filled at an auto parts store or service station with fresh fluid, it eliminates the need for disposable fluid containers. The customer can recycle his used fluid at any collection point. He can also simply use the evacuation part of the system and fill his application with the traditional quart containers.

Thus, the scope of the invention should be determined by the appended claims and their legal equivalents, rather than by the examples given.

What is claimed is:

1. A fluid changing system for changing fluid in an application, said fluid changing system comprising:

a remotely mounted oil filter boss, said oil filter boss fluidly connected with a fluid pump and a lubrication system, at least one feed line connected to feed the oil filter boss with fluid from the fluid pump, at least one return line connected to return fluid from the oil filter boss to the lubrication system, said feed line and said return line being fluid conduits, a fluid filter in fluid communication with said feed line and said return line, a first quick disconnect coupling fluidly connected to said oil filter boss, a second quick disconnect coupling being a terminal end of a fluid conduit in fluid communication with a fluid sump, and both first and second quick disconnect couplings able to be realeasably connected to at least one fluid pump, said fluid pump being operable under both pressure and vacuum to transfer fluid both to and from the fluid filter and the fluid sump.

2. The system of claim 1 wherein said first quick disconnect coupling is connected downstream of said oil filter boss.

3. The system of claim 1 wherein said first quick disconnect coupling is connected upstream of said oil filter boss.

4. The system of claim 1, further including a sealable container housing said fluid filter, said first quick disconnect coupling, and said second quick disconnect coupling.

5. The system of claim 1 further comprising:

at least one dirty fluid holding tank in fluid communication with said fluid pump, and at least one fresh fluid reservoir in fluid communication with said fluid pump.

6. The system of claim 5 further comprising at least one pump out nozzle and at least one fill nozzle in fluid communication with said fluid pump, said pump out nozzle and said fill nozzle able to be releaseably connected to said first quick disconnect coupling and said second quick disconnect coupling.

7. The system of claim 6 further including an information transfer device that communicates information between said fluid pump, the application, and a customer servicing the application.

8. The system of claim 5 further including a single service coupling in fluid communication with said fluid pump, able to be releaseably connected to said first quick disconnect coupling and said second quick disconnect coupling.

9. The system of claim 8 further including an information transfer device that communicates information between said fluid pump, the application, and a customer servicing the application.

10. The system of claim 5 further including an information transfer device that communicates information between said fluid pump, the application, and a customer servicing the application.

11. A fluid changing system for changing fluids in an application, said fluid changing system comprising:

a remotely mounted oil filter boss, fluid transfer means for transferring fluid from the application's fluid pump to said remotely mounted oil filter boss, then in turn to the application's lubrication system, a first quick disconnect coupling fluidly connected to said fluid transfer means, a second quick disconnect coupling being a terminal end of a fluid conduit in fluid communication with a fluid sump, and both first and second quick disconnect couplings able to be releasably connected to an external pump means for the transfer of fluid both to and from the fluid filter and fluid sump, said external pump means being operable under both pressure and vacuum.

12. The system of claim 11 further including a sealable container housing said fluid filter, said first quick disconnect coupling, and said second quick disconnect coupling.

13. The system of claim 11, further comprising:

at least one dirty fluid holding tank in fluid communication with said external pump means, at least one clean fluid reservoir in fluid communication with said external pump means, and a connection means for connecting said external pump means to said first quick disconnect coupling and said second quick disconnect coupling.

14. The system of claim 13 further including an information transfer means able to communicate fluid change information between said external pump means, the application, and a customer servicing the application.

* * * * *